United States Patent [19]

Fujiwara et al.

[11] Patent Number: 4,560,295

[45] Date of Patent: Dec. 24, 1985

[54] SHEET PRESSER MECHANISM FOR RECORDERS WITH PIVOTABLE COVER PLATE

[75] Inventors: Mitsugu Fujiwara; Yoshinori Sakaue, both of Morioka; Tomio Aso, Kitakami; Koshiro Kurokawa, Hanamaki; Hideo Obara, Ezuriko, all of Japan

[73] Assignee: Alps Electric Co. Ltd., Japan

[21] Appl. No.: 505,081

[22] Filed: Jun. 16, 1983

[30] Foreign Application Priority Data

| | | | |
|---|---|---|---|
| Jun. 17, 1982 | [JP] | Japan | 57-90831[U] |
| Jun. 17, 1982 | [JP] | Japan | 57-90832[U] |
| Jun. 17, 1982 | [JP] | Japan | 57-90833[U] |
| Jun. 17, 1982 | [JP] | Japan | 57-90834[U] |

[51] Int. Cl.[4] ..... B41J 13/042; B41J 29/02

[52] U.S. Cl. ..... 400/637.1; 400/690.4; 400/693; 400/713; 346/136

[58] Field of Search ..... 400/637, 637.1, 641, 400/662, 663, 664, 689, 637.3, 637.4, 639, 639.1, 679, 690.4, 691, 693, 713, 636, 636.1, 647, 647.1; 346/134, 136

[56] References Cited

U.S. PATENT DOCUMENTS

| | | | |
|---|---|---|---|
| 1,216,857 | 2/1917 | Shammo | 400/713 |
| 1,368,620 | 2/1921 | Foster | 400/713 |
| 1,568,338 | 1/1926 | Kurowski | 400/689 |
| 2,142,245 | 1/1939 | Helmond | 400/637.1 |
| 2,389,813 | 11/1945 | Pfeiffer | 400/636 |
| 2,713,932 | 7/1955 | Letterman | 400/637.1 |
| 4,042,091 | 8/1977 | Levinson et al. | 400/637.3 |
| 4,179,224 | 12/1979 | Feldman et al. | 400/637 |
| 4,340,315 | 7/1982 | Teichmann et al. | 400/690.4 |

*Primary Examiner*—Edgar S. Burr
*Assistant Examiner*—David A. Wiecking
*Attorney, Agent, or Firm*—Guy W. Shoup

[57] ABSTRACT

A sheet presser mechanism for use in a recorder comprises a platen rotatable about its own axis, a drawing instrument directed toward the platen and movable axially thereof, a pair of spaced support members movable toward and away from the platen, a pair of presser roller units rotatably supported on the support members, respectively, and positioned respectively at axial ends of the platen. The presser rollers have shafts parallel to the platen and normally held resiliently against the platen, and a paper presser bar is spaced from the presser rollers in a circumferential direction of the platen so as to extend parallel to the platen. A pivot lever with a cover thereon supports the paper presser bar for moving the latter away from the platen, and a pair of presser members are actuatable in response to turning movement of the pivot lever to move the paper presser bar away from the platen for pushing the support members to move the presser rollers away from the platen.

5 Claims, 9 Drawing Figures

SHEET PRESSER MECHANISM FOR RECORDERS WITH PIVOTABLE COVER PLATE

BACKGROUND OF THE INVENTION

The present invention relates to a recorder such as a pen recorder, and more particularly to a mechanism of such recorders which holds a recording sheet in position against a platen by rollers displaceable out of engagement with the platen when the sheet is to be inserted or removed.

Prior recorders such as pen recorders and printers have presser rollers urged toward a platen for pressing a sheet of recording paper against and around the platen. Some recorders also include a presser bar spaced from the presser rollers for preventing the leading edge of the sheet from lifting off the platen. When the sheet is to be released from the platen or positioned on the platen, the presser bar and the presser rollers need to be separately released from the platen through the use of levers, for example. Therefore, the procedure for positioning a sheet is relatively complex to perform, and cannot be carried out in a short period of time.

SUMMARY OF THE INVENTION

It is an object of the present invention to provide a sheet presser mechanism for use in recorders wherein a sheet of recording paper can be positioned easily in one operation.

According to the present invention, a sheet presser mechanism includes presser rollers having shafts parallel to the shaft of a platen and positioned at ends of the latter, and a presser bar positioned in spaced relation to the presser rollers, the presser rollers being movable in unison away from the platen when the presser bar is moved away from the platen.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
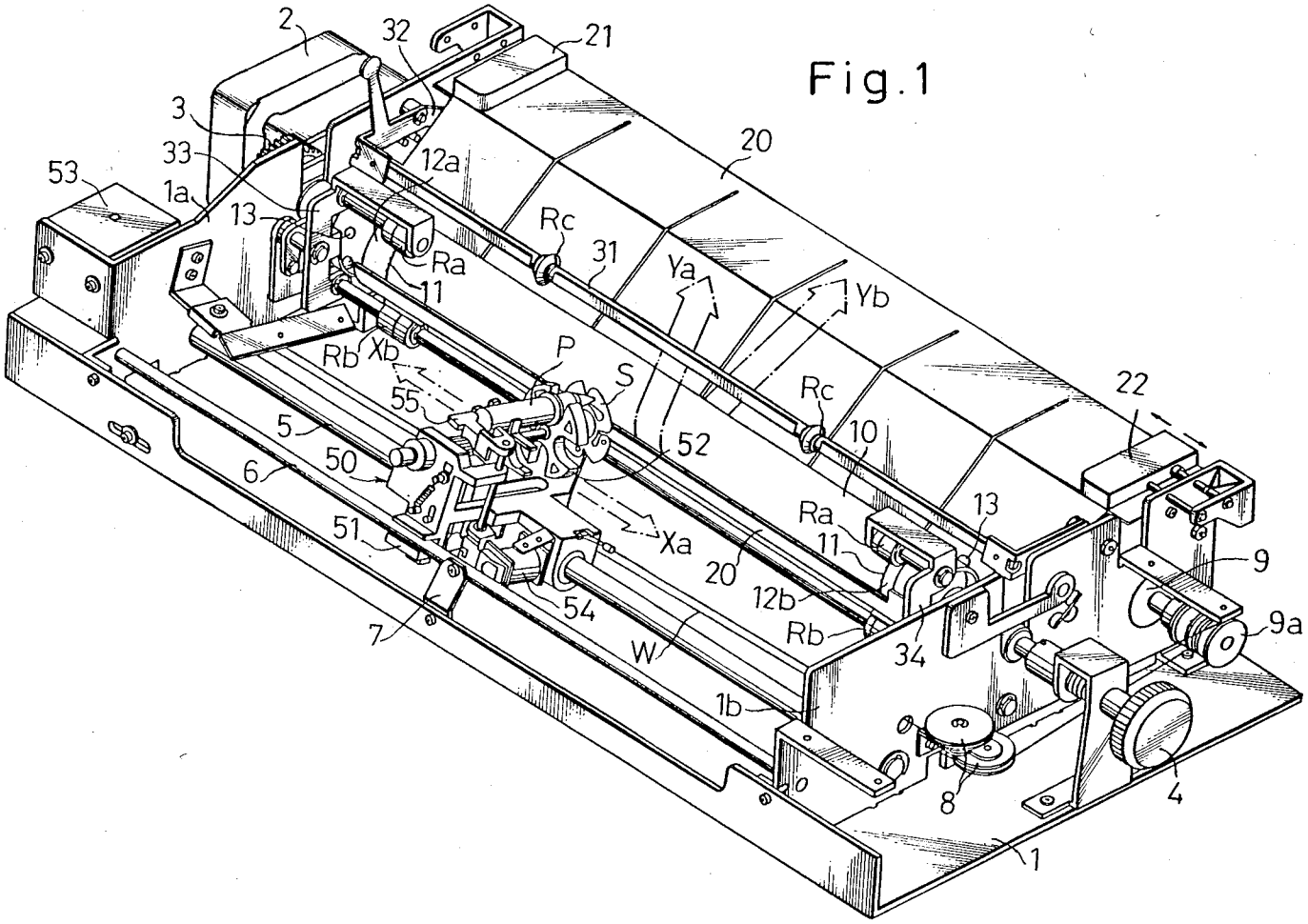
FIG. 1 is a perspective view of a pen recorder in which the present invention is incorporated.

FIG. 1 shows in perspective a multi-color pen recorder according to the present invention. The multi-pen recorder draws characters, figures or other patterns on a sheet (not shown) by controlling the movement of a pen P of selected ink color in the directions of the arrows Xa and Xb while controlling actuation of a platen 10 to feed the sheet in the directions of the arrows Ya and Yb.

The platen 10 is rotated about its own axis selectively in one direction or the other through a gear 3 and a stepper motor 2 mounted on a base 1. The platen 10 may manually be rotated by a knob 4 attached to an end of the shaft of the platen 10. The sheet on which characters and graphic patterns are to be drawn is inserted across and over a guide plate 20 extending below the platen 10 and turned up therearound in the direction of the arrow Ya. The guide plate 20 has thereon a fixed positioning member 21 and a movable positioning member 22 for guiding the opposite edges of the sheet while the latter is fed below the platen 10. The movable positioning member 22 is movable in the directions of the arrows to positions in which the spacing between the positioning members 21 and 22 fits sheet dimensions such as A4 size and B5 size. The sheet as it is fed below the platen 10 is guided by a distal end of the guide plate 20 toward the side of the platen 10 on which recording takes place. The sheet is then gripped in place between the platen 10 and two laterally spaced pairs of presser rollers Ra, Rb. The leading edge of the sheet passes in the direction of the arrow Ya below paper presser rollers Rc located above the platen 10. The paper presser rollers Rc are rotatably mounted on a presser bar 31 extending parallel to the platen 10, and serve to prevent the leading edge of the sheet from coming toward the pen P while recording is being effected on the sheet.

Figure 7:
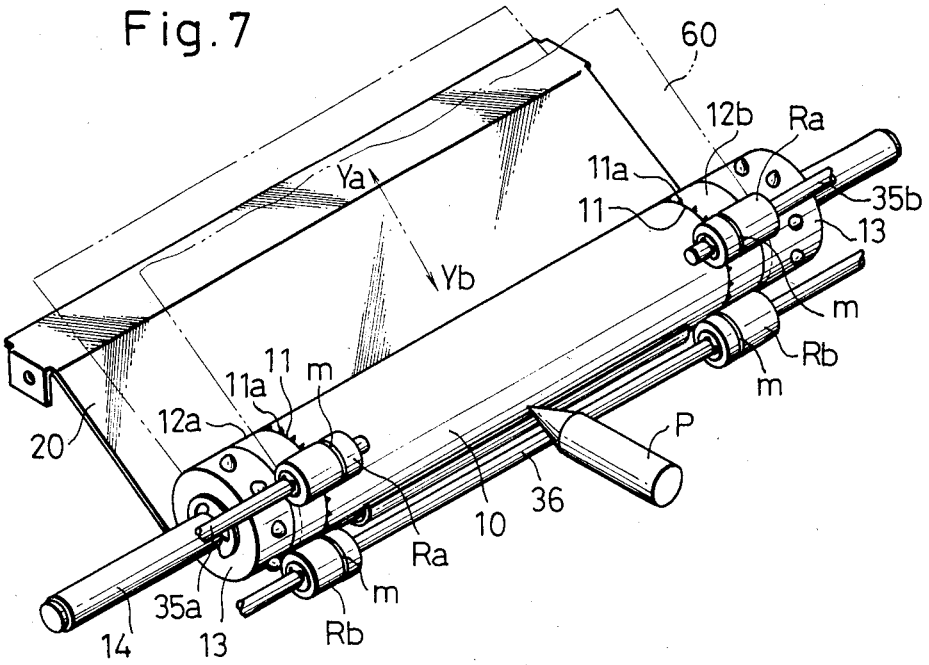
FIG. 7 is a fragmentary perspective view of the sheet presser mechanism, illustrative of the manner in which a sheet of print paper is gripped and fed along.

As shown clearly in FIG. 7, circular toothed plates 11 are mounted on respective ends of the platen 10. Sprockets 13, 13 are corotatably mounted on respective ends of the platen 10 with rollers 12*a*, 12*b* of short axial dimension disposed between the sprockets 13, 13 and adjacent toothed plates 11, 11. When the sheet has feed holes formed in margins thereof, the projections on the sprockets 13 fit into such feed holes for positive feeding of the sheet. The sheet can therefore be fed along in the directions of the arrows Ya and Yb in full synchronism with rotation of the platen 10. In the case where the sheet has no feed holes, that is, the sheet is so-called letter paper, the lateral edges of the sheet are clamped between the toothed plate 11 and the presser rollers Ra, Rb. Accordingly, the sheet in the form of letter paper can positively be fed along in the directions of the arrows Ya and Yb in full synchronism with rotation of the platen 10. This positive synchronization between the feeding of the sheet and the rotation of the platen 10 serves to increase the accuracy with which characters and other patterns are drawn on the sheet. The increased accuracy is quite important for the following reason: When drawing graphs or figures on the sheet, it is sometimes necessary to feed the sheet in the directions of the arrows Ya and Yb over a long interval while moving the pen P back and forth in the directions of the arrows Xa and Xb. If the sheet should slip on the platen 10, the sheet would not be fed properly, causing the pattern drawn on the sheet to be distorted.

When loading and positioning the sheet, the presser rollers Ra, Rb need to be lifted off the platen 10, and this is accomplished by raising the presser bar 31. More specifically, the presser rollers Ra, Rb are mounted on support members 33, 34 which can be moved away from the platen 10 in response to upward movment of a pivot lever 32 that supports the paper presser shaft 31.

The pen P is supported on a pen carriage 50. The base 1 has a pair of laterally spaced side plates 1*a*, 1*b* mounted thereon with a main shaft 5 extending between the side plates 1*a*, 1*b* parallel to the platen 10. The pen carriage 50 is slidably mounted on the main shaft 5 for movement in the directions of the arrows Xa and Xb. An auxiliary shaft 6 extends parallel to the main shaft 5 rearwardly thereof and has its ends fixed to the side plates 1*a*, 1*b*. The pen carriage 50 has a rear guide slot 51 slidably fitted over the auxiliary shaft 6. The pen carriage 50 is therefore supported by both the main shaft 5 and the auxiliary shaft 6. The main shaft 5 and the auxiliary shaft 6 are relatively positioned to determine an angle at which the pen P on the pen carriage 50 is directed to the platen 10. In the illustrated embodiment, the pen carriage 50 is angularly positioned with respect to the platen 10 so that the tip end of the pen P is oriented downwardly. The downwardly tilted tip end allows ink to flow smoothly out of the pen P. The auxiliary shaft 6 is of a diameter smaller than that of the main shaft 5. This fact, together with the relatively long distance between the side plates 1*a*, 1*b*, tends to allow the auxiliary shaft 6 to flex centrally. To avoid this, the central portion of the auxiliary shaft 6 is supported by a support bracket 7 mounted on the base 1. The support bracket 7 keeps the auxiliary shaft parallel to the main shaft 5. As a result, the pen P is maintained at a fixed angle with respect to the platen 10 while the pen carriage 50 moves in the directions of the arrows Xa and Xb.

A wire W for driving the pen carriage 50 in the directions of the arrows Xa and Xb is attached to lateral sides of the pen carriage 50. The wire W is trained around pulleys 8 rotatably mounted on outer sides of the side plates 1*a*, 1*b* (only those on the side plate 1*b* being shown) and also around a drive pulley 9*a* of a stepper motor 9 disposed below the guide plate 10. When the stepper motor 9 is driven to rotate its drive pulley 9*a* in one direction or the other, the wire W moves the pen carriage 50 in the direction of the arrow Xa or Xb.

Four pens P can be supported on a pen holder 52 rotatably mounted on the pen carriage 50. (Only one pen P is shown in FIG. 1.) The pen holder 52 can be rotated by a solenoid 53 mounted on the outer side of the side plate 1*a*. More specifically, the main shaft 5 which is noncircular in cross section is turned about its own axis through a certain angle in response to attractive energization of the solenoid 53. The turning movement of the main shaft 5 is transmitted to a ratchet mechanism in the pen carriage 50 for angularly moving the pen holder 52 until a desired pen P is brought to a writing position (uppermost position). The pen P is normally retracted away from the platen 10 under the bias of a return leaf spring S. When a hammer 55 on the pen carriage 50 is driven by a solenoid 54 mounted thereon, the hammer 55 pushes the pen P in the writing position to press the tip end of the pen P against the platen 10.

More specifically, the pen holder 52 is turned continuously until a pen P with ink of a desired color is moved to the uppermost writing position. Thereafter, the stepper motor 2 is energized to rotate the platen 10 to feed the sheet clamped between the platen 10 and the presser rollers Ra, Rb in the directions of the arrows Ya and Yb. At the same time, the stepper motor 9 is energized to move the pen carriage 50 in the directions of the arrows Xa and Xb. The pen P is then pushed by the hammer 55 to force its tip end against the sheet on the platen 10 to thereby draw characters, a figure or a graph in the pattern dependent on movements of the sheet and the pen P in the X - Y directions.

A sheet presser mechanism according to an embodiment of the present invention will be described with reference to FIGS. 2 through 4.

The support member 33 (on the lefthand side) and the support member 34 (on the righthand side) for the presser rollers Ra, Rb are made of sheet metal and have upper support arms 33*a*, 34*a*, respectively. Shafts 35*a*, 35*b* are supported below the support arms 33*a*, 34*a*, respectively. The upper presser rollers Ra are idly mounted for rotation on the shafts 35*a*, 35*b*, respectively, and retained thereon by E rings (not shown). The support arm 33*a* of the left hand support member 33 is longer than the support arm 34*a* of the righthand support member 34. This is because the left hand toothed plate 11 on the platen 10 is closer to the center of the platen 10 than the right hand toothed plate 11. More specifically, the left hand presser roller Ra is located more closely to the center of the platen 10 than the right hand presser roller Ra to allow the presser rollers Ra to be held against the toothed plates 11. Therefore, the support arm 33*a* is longer than the support arm 34*a*. The support members 33, 34 have support holes, respectively, in their lower end portions (only the support hole 33*b* in the support member 33 is shown). A connector shaft 36 extends through the support holes and has opposite ends on which the lower presser rollers Rb are idly mounted for rotation, respectively. The presser rollers Rb are retained on the connector shaft 36 by E rings 37*a*. The connector shaft 36 serves to allow the presser rollers Rb to rotate thereon and also to cause the support members 33, 34 to operate in synchronism. The left hand support member 33 is coupled to a pivot member 38, and the righthand support member 34 is coupled to a pivot member 39. The support member 33 has a holder 33*c* bent outwardly from a central portion of the support member 33 and having upper and lower support holes 33*d*, 33*f*. The upper support hole 33*d* is in alignment with a central support hole 33*e* defined in the support member 33. The pivot member 38 has a longer pin 38*a* and a shorter pin 38*b*, both extending laterally from the pivot member 38. The longer pin 38*a* extends through the support holes 33*d*, 33*e* in the support member 33 and is retained by an E ring 37*b*. The shorter pin 38*b* is inserted in the support hole 33*f* in the support member 33. The two pins 38*a*, 38*b* thus serve to couple the pivot member 38 and the support member 33 with each other. Likewise, the righthand support member 34 has a pair of aligned support holes 34*d*, 34*e* and a support hole 34*f*. The pivot member 39 has a longer pin 39*a* and a shorter pin 39*b*. The longer pin 39*a* is inserted in the support holes 34*d*, 34*e* and retained by an E ring 37*b*. The shorter pin 39*b* is inserted in the support hole 34*f*. Thus, the support member 34 and the pivot member 39 are coupled with each other. The pivot member 38 has a pair of aligned support holes 38*c*, and similarly the pivot member 39 has a pair of aligned support holes 39*c*. A support shaft 40 has opposite end portions rotatably inserted in the support holes 38*c*, 39*c*, respectively. The ends of the support shaft 40 are supported on the side plates 1*a*, 1*b*, respectively, on the base 1 (only the side plate 1*a* is shown in FIG. 2). The pivot members 38, 39 are normally urged by springs 41*a*, 41*b*, respectively, toward the platen 10. The presser rollers Ra, Rb are normally biased into pressing engagement with peripheral surfaces of the ends of the platen 10. The pivot members 38, 39 have on lower ends fingers 38*d*, 39*d* directed toward the platen 10 to lie alongside the ends thereof.

The paper presser rollers Rc are in the form of abucus beads and are mounted idly for rotation on the presser bar 31. The paper presser rollers Rc are positioned on the presser bar 31 by E rings 37*c*. The ends of the presser bar 31 are fixed to the pivot levers 32, 42, respectively, by pins 43*a*, 43*b*. The pivot lever 32 has a support hole 32*a* defined therein in which there is inserted a pin 44 affixed to an inner side of the side plate 1*a* to allow the pivot lever 32 to turn on the pin 44. The pivot lever 32 is retained on the pin 44 by an E ring 37*d*. The pivot lever 42 has a support hole 42*a* defined therein. A pin (not shown) identical with the pin 44 is fixed to an inner side of the side plate 1*b* and inserted in the support hole 42*a* so that the pivot lever 42 can turn on the pin. The pivot lever 32 has integral manipulating bar 32*b*. A pin 32*c* is fixed to the pivot lever 32 and joined to an upper end of a coupling lever 45, which has a lower end coupled to a presser member 46. The presser member 46 has a noncircular aperture 46*a* defined therein. A shaft 48 has one end fitted in the aperture 46*a*. A presser member 47 also has a noncircular aperture 47*a* in which the other end of the shaft 48 is fitted. The ends of the shaft 48 are supported on the side plates 1*a*, 1*b* for allowing the shaft 48 to turn about its own axis. The shaft 48 has a cross section that is substantially the same as the shape of the apertures 46*a*, 47*a* in the presser members 46, 47. Therefore, the presser members 46, 47 and the shaft 48 are coupled with each other for corotation. The presser members 46, 47 have integral pressers 46*b*, 47*b*, respectively. As shown in FIG. 3, the presser 46*b* is disposed below the finger 38*d* of the pivot member 38, and the presser 47*b* is similarly positioned below a finger of the pivot member 39. A spring 49*a* has one arm engaging the pin 32*c* of the pivot lever 32 and the other arm inserted in a small hole 1*c* defined in the side plate 1*a*. A pair of stops 49*b*, 49*c* are secured to an inner side of the side plate 1*a*.

Figure 2:
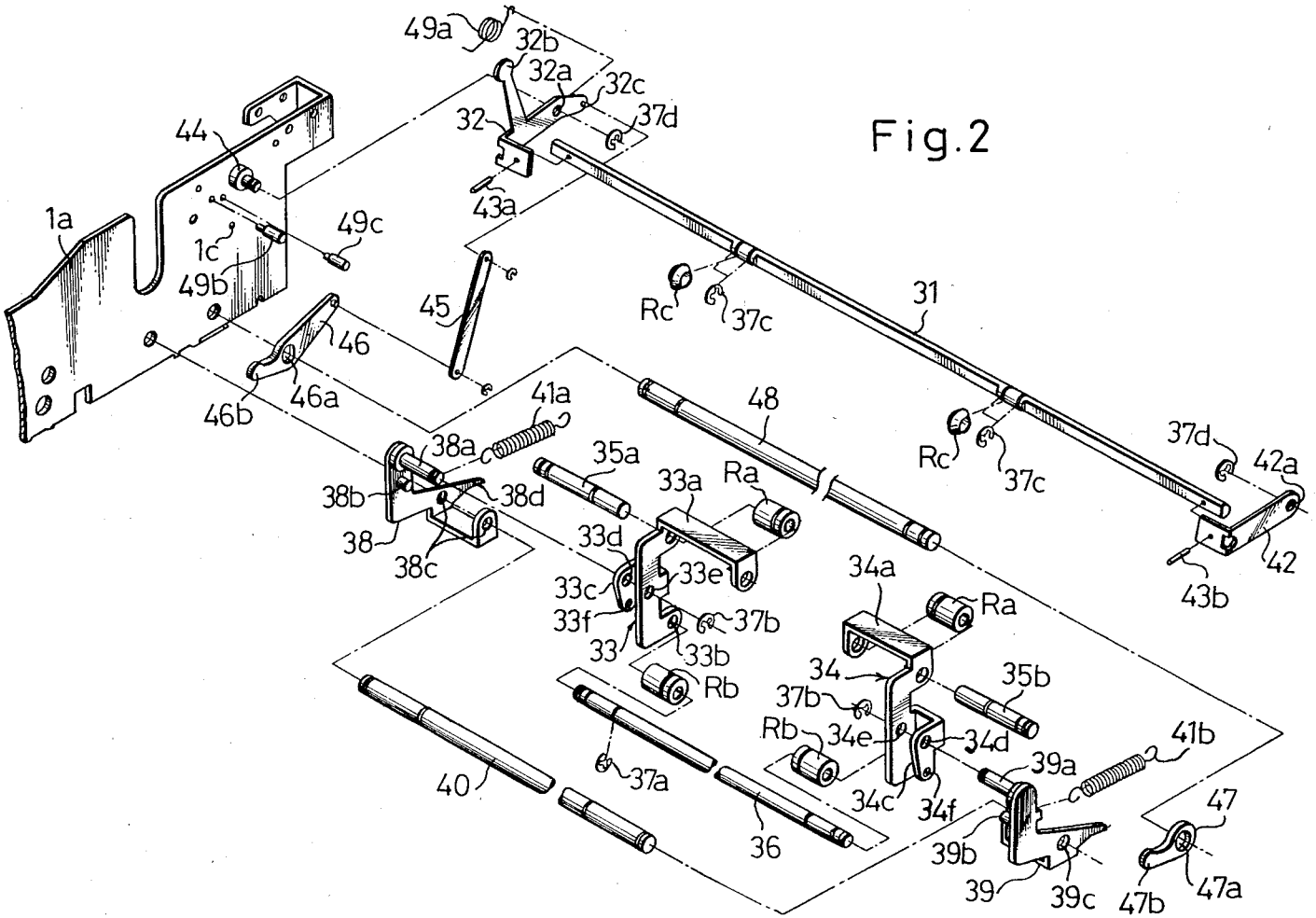
FIG. 2 is an exploded perspective view of a sheet presser mechanism according to the present invention.
Figure 3:
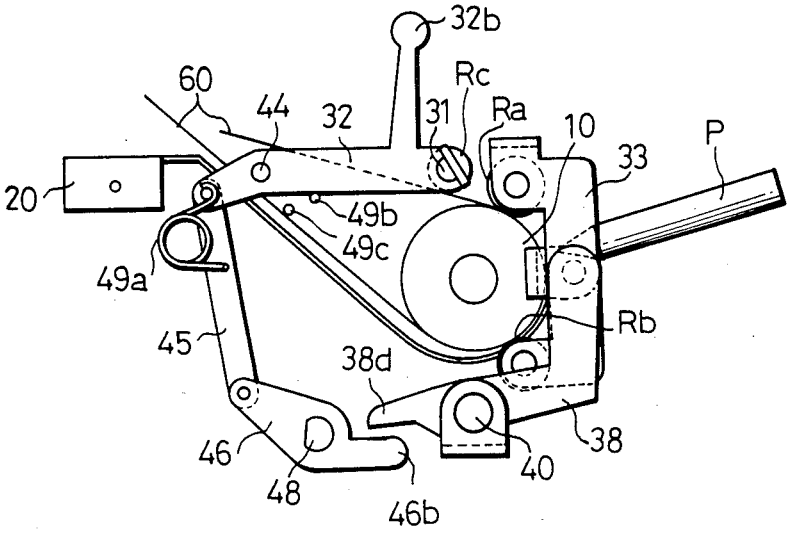
FIGS. 3 and 4 are enlarged side elevational views of the sheet presser mechanism of FIG. 2, showing different operating positions.
Figure 4:
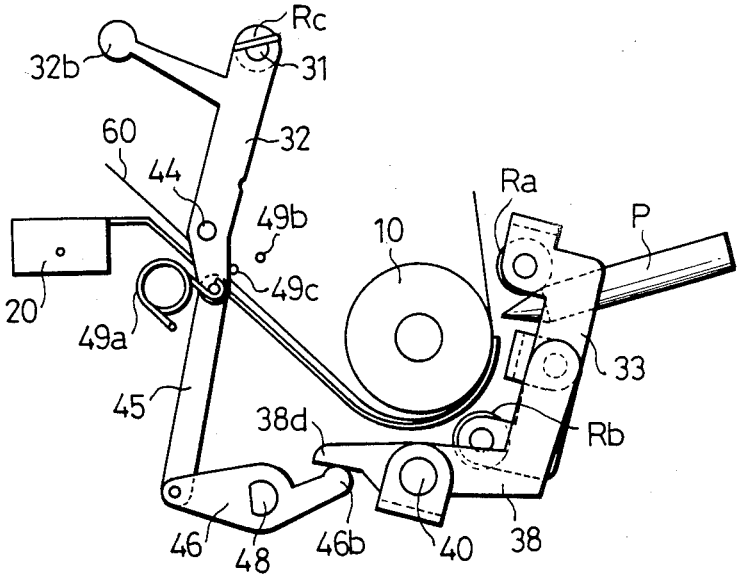

Operation and advantages of the sheet presser mechanism thus constructed are as follows:

FIGS. 3 and 4 show the sheet presser mechanism as seen from the left in FIGS. 1 and 2. FIG. 3 is illustrative of a writing position, and FIG. 4 of a nonwriting position.

For writing operation, the paper presser bar 31 is lowered near the platen 10. The pivot lever 32 is turned clockwise about the pin 44 and urged by the spring 49*a* into abutment against the stop 49*b*. In this position, the paper presser rollers Rc are spaced a certain distance from the platen 10. The presser member 46 which is coupled by the coupling lever 45 to the pivot lever 32 is turned clockwise about the shaft 48 with the distal presser 46*b* spaced from the finger 38*d* of the pivot member 38. The presser 47, located on the righthand side of FIG. 2, is turned with the shaft 48 in the same direction as that of angular displacement of the presser member 46. Therefore, the pivot members 38, 39 are released from engagement with the presser members 46, 47, respectively, and are pulled by the springs 41*a*, 41*b* toward the platen 10. The presser rollers Ra, Rb are pressed against the platen 10 under the resilient forces of the springs 41*a*, 41*b*. A sheet of print paper 60 can thus be clamped between the platen 10 and the presser rollers Ra, Rb. An upper leading edge of the sheet 60 extends below the paper presser rollers Rc rearwardly thereof. The pen P is located substantially centrally of a paper support structure composed of the presser rollers Ra, Rb. The paper presser rollers Rc serve to prevent the sheet from being turned upwardly from the platen 10.

When the sheet 60 is to be loaded or positioned, the manipulating bar 32*b* is pulled up to lift the pivot lever 32 as shown in FIG. 4. As the pivot lever 32 is raised beyond a certain point, the pivot lever 32 is urged by the spring 49*a* in a different direction such that the lower end of the pivot lever 32 is resiliently biased into abutment against the stop 49*c*. The pivot lever 32 is now held in an elevated position. This movement of the pivot lever 32 is transmitted through the coupling lever 45 to the presser member 46, which is turned counterclockwise. The presser member 47 coupled to the presser member 46 by the shaft 48 is also turned in the same direction. The pressers 46*b*, 47*b* of the presser members 46, 47 push the fingers 38*d*, of the pivot members 38, 39, respectively. The pivot members 38, 39 and the support members 33, 34 coupled therewith are pushed away from the platen 10, whereupon the presser rollers Ra, Rb are moved out of contact with the sheet 60 simultaneously. Consequently, the sheet 60 can instantly be freed by turning the pivot levers 32, 42 and hence the presser bar 31 upwardly. With the parts in the released position, a sheet 60 can be loaded into position or positioned for proper setting.

In the illustrated embodiment, the support members 33, 34 supporting the presser rollers Ra, Rb can be turned about the shaft 40 on the pivot members 38, 39. However, the support members 33, 34 may be arranged to be slidable rectilinearly toward and away from the platen 10, and the presser members 46, 47 may be arranged to push the support members 33, 34 away from the platen 10. Furthermore, the presser members 46, 47 may be integral with the pivot levers 32, 42, respectively. The presser members 46, 47 may be coupled to the fingers 38*d*, of the pivot members 38, 39, respectively.

While in the illustrated embodiment pens are used as drawing instruments, dot matrix print heads or printing type may also be employed as the drawing instruments.

With the foregoing arrangement, two pairs of rollers can be released from the platen simultaneously by moving the presser bar away from the platen. A sheet can therefore be loaded or positioned in a single operation.

Figure 5:
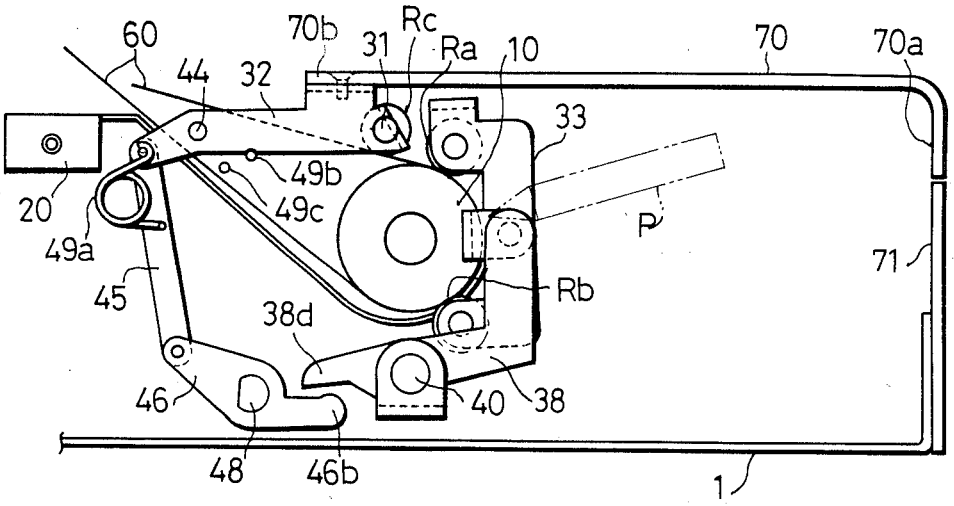
FIGS. 5 and 6 are enlarged side elevational views of a sheet presser mechanism according to another embodiment of the present invention.
Figure 6:
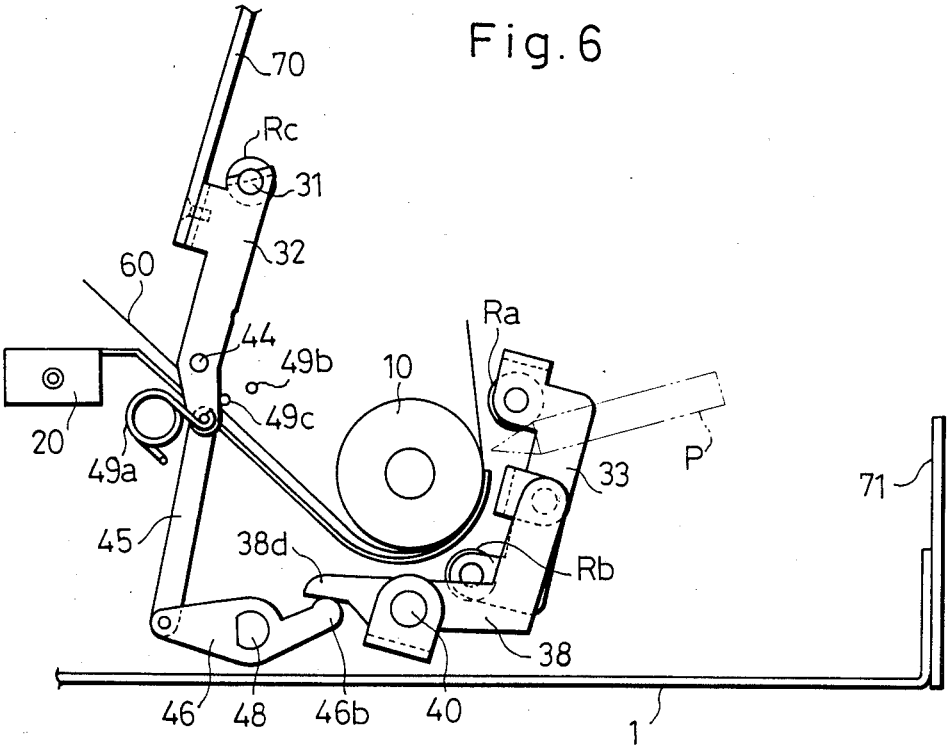

FIGS. 5 and 6 show a sheet presser mechanism according to a second embodiment of the present invention. In the second embodiment, a cover plate 70 is attached to the pivot lever 32. During writing operation, the cover plate 70 covers the platen 10 and the pen P, and the paper presser bar 31 is lowered near the platen 10. The pivot levers 32, 42 that support the cover plate 70 and the paper presser bar 31 are turned clockwise (FIG. 5) about the pin 44 during the writing operation, and the pivot lever 32 is urged into abutment against the stop 49*b* under the force of the spring 49*a*. At this time, the paper presser rollers Rc are spaced a fixed distance from the platen 10. The presser member 46 which is coupled by the coupling lever 45 to the pivot lever 32 is turned clockwise about the shaft 48 with the distal presser 46*b* spaced from the finger 38*d* of the pivot member 38. The presser 47, located on the righthand side of FIG. 2, is turned with the shaft 48 in the same direction as that of angular displacement of the presser member 46. Therefore, the pivot members 38, 39 are released of engagement with the presser members 46, 47, respectively, and are pulled by the springs 41*a*, 41*b* toward the platen 10. The presser rollers Ra, Rb are pressed against the platen 10 under the resilient forces of the springs 41*a*, 41*b*. A sheet of print paper 60 can then be clamped between the platen 10 and the presser rollers Ra, Rb. An upper leading edge of the sheet 60 extends below the paper presser rollers Rc rearwardly thereof toward an upper rear position on the guide plate 20. The pen P is located substantially centrally of a paper support structure composed of the presser rollers Ra, Rb. The paper presser rollers Rc serve to prevent the sheet from being turned upwardly into contact with the cover plate 70.

When the cover plate 70 is opened upwardly as shown in FIG. 6, the pivot levers 32, 42 joined therewith are turned counterclockwise about the pin 44. The paper presser bar 31 supported by the pivot levers 32, 42 is moved away from the platen 10. As the pivot levers 32, 42 are angularly moved beyond a certain point, the pivot lever 32 is urged by the spring 49*a* in a different direction such that the lower end of the pivot lever 32 is resiliently biased into abutment against the stop 49*c*. The cover plate 70 is now stopped in an elevated position. This movement of the pivot lever 32 is transmitted through the coupling lever 45 to the presser member 46, which is turned counterclockwise. The presser member 47 coupled to the presser member 46 is also turned in the same direction through the shaft 48. The pressers 46*b*, 47*b* of the presser members 46, 47 push the fingers 38*d*, of the pivot members 38, 39, respectively. The pivot members 38, 39 and the support members 33, 34 coupled therewith are pushed away from the platen 10 against the resilient forces from the springs 41*a*, 41*b*, whereupon the presser rollers Ra, Rb are moved out of contact with the sheet 60 simultaneously. Consequently, the sheet 60 can instantly be freed by opening the cover plate 70 upwardly to turn the pivot levers 32, 42 upwardly, thereby releasing the paper presser bar 31 off the platen 10 and the presser rollers Ra, Rb off the platen 10 at the same time. With the parts in the released position, a sheet 60 can be loaded into position or positioned for a proper setting.

In the illustrated embodiment, the support members 33, 34 supporting the presser rollers Ra, Rb can be turned about the shaft 40 on the pivot members 38, 39. However, the support members 33, 34 may be arranged to be slidable rectilinearly toward and away from the platen 10, and the presser members 46, 47 may be arranged to push the support members 33, 34 away from the platen 10. Furthermore, the presser members 46, 47 may be integral with the pivot levers 32, 42, respectively. The presser members 46, 47 may be coupled to the fingers 38*d*, of the pivot members 38, 39, respectively.

With the arrangement shown in FIGS. 5 and 6, the presser rollers and the paper presser bar can instantly be moved away from the platen by opening the cover plate upwardly, thus allowing a sheet of print paper to be loaded and positioned quite easily in a single operation. Since the cover plate doubles as a manipulating lever, no separate manipulating lever needs to be provided, and the overall appearance of the recorder can be of a simple design.

Where two presser rollers are disposed at each end of the platen, all of the presser rollers can simultaneously be moved away from the platen by actuating the presser bar. In the illustrated pen recorder having the toothed plates 11 and sprockets 13 at the ends of the platen 10, sheets can smoothly be loaded and unloaded simply by releasing all of the presser rollers off the platen at the same time.

The manner in which a sheet of print paper 60 is clamped and fed along by the platen 10 and the presser rollers Ra, Rb will be described in greater detail with reference to FIGS. 7 through 9.

Toothed plates 11 are mounted on the platen 10 at its ends, respectively. Sprockets 13 are mounted in axially spaced relation to the toothed plates 11 with rollers 12*a*, 12*b* (lefthand and righthand, respectively) of short axial dimension being interposed therebetween. The platen 10, the toothed plates 11, the rollers 12*a*, and the sprockets 13 are all fixedly mounted on the shaft 14. The ends of the shaft 14 are rotatably supported on the lefthand side plate 1*a* and the righthand side plate 1*b* on the base 1 (FIG. 1). The shaft 3, shown in FIG. 1, is attached to the lefthand end of the shaft 14. Each of the toothed plates 11 is disc-shaped as illustrated in FIG. 9, having a plurality of teeth 11*a* arrayed around a peripheral edge. The toothed plates 11 may be made by stamping a thin sheet of metal. The toothed plates 11 are axially sandwiched between the platen 10 and the rollers 12*a*, 12*b* with the teeth 11*a* projecting radially beyond the peripheral surface of the platen 10.

The upper presser rollers Ra are idly mounted for rotation on separate support shafts 35*a*, 35*b*, respectively, and the lower presser rollers Rb are idly mounted for rotation on a single support shaft 36. The support shaft 35*a* is supported on the support member 33 (shown in FIG. 1), and the support shaft 35*b* is supported on the support member 34. The support shaft 36 has a left hand end fixed to the support member 33 and a right hand end to the support member 34. The support shafts 35*a*, 35*b* and 36 extend parallel to the shaft 14 of the platen 10. The support shafts 35*a*, 35*b* are spaced a certain interval from the support shaft 36 in the circumferential direction of the platen 10. The support members 33, 34 are urged toward the platen by springs. The presser rollers Ra, Rb are kept in pressing contact with the circumferential surface of the platen 10 under the resiliency of these springs. As shown in FIGS. 1 through 6, there is a link mechanism for causing the support members 33, 34 and hence the presser rollers Ra, Rb to be moved away from the platen 10 by turning the pivot lever 32 attached to one end of the paper presser bar 31 to thereby displacing the latter away from the platen 10. The presser rollers Ra, Rb are made of synthetic resin, and each have a groove m on the peripheral surface. The groove m extends in the circumferential direction of the presser rollers Ra, Rb, and has a depth large enough to accommodate and hence avoid direct engagement with the teeth 11*a* of the toothed plates 11 when the presser rollers Ra, Rb are pressed against the platen 10.

Operation and advantages of the construction shown in FIGS. 7 through 9 will be described.

A variety of sheets of recording paper can be used on the pen recorder of the invention. Where the sheet has feed holes along opposite marginal edges, the teeth of the sprockets 13 are fitted into such feed holes. The engagement of the sprocket teeth in the feed holes enables the sheet to be positively fed along in the directions of the arrows Ya and Yb in synchronism with rotation of the platen 10. Where the sheet is composed of so-called letter paper (indicated by 60 in FIG. 7) having no feed holes along its marginal edges, the edges of the sheet is strongly gripped between the teeth 11*a* of the toothed plates 11 and the grooves m in the presser rollers Ra, Rb. The sheet 60 can also positively be fed along in the directions of the arrows Ya and Yb in full synchronism with rotation of the platen 10.

By thus feeding the sheet in the directions of the arrows Ya and Yb while being engaged by the sprockets 13 or the toothed plates 11, the sheet can be moved in synchronism with the platen 10 without slipping thereover. This synchronized slippage-free feeding allows a relatively long line to be drawn by a pen P on the sheet accurately without distortion while the sheet is being fed reciprocably in the directions of the arrows Ya and Yb.

Figure 8:
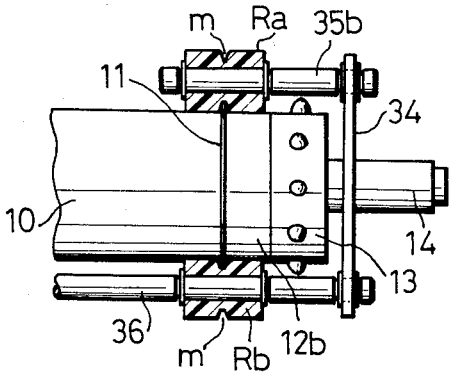
FIG. 8 is an enlarged fragmentary cross-sectional view of the sheet presser mechanism.

While in the embodiment shown in FIG. 8 the toothed plates 11 are disposed respectively at the ends of the platen 10, only one toothed plate may be provided at one end of the platen 10. Only one set of the presser rollers Ra, Rb, for example the presser rollers Ra, may be provided with grooves m for coaction with the teeth 11*a*, and the other presser rollers Rb may dispense with any groove m and be held against the platen in positions out of engagement with the teeth 11*a*.

Figure 9:
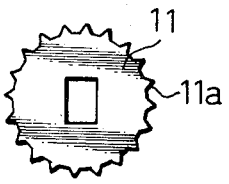
FIG. 9 is a front elevational view of a toothed plate in the sheet presser mechanism.

With the arrangement of FIGS. 7 through 9, the teeth are provided on the peripheral surface of the platen and the presser rollers have grooves to avoid direct engagement with the teeth. The edges of a sheet of print paper are firmly gripped between the teeth and the grooves. Therefore, the feeding of the sheet is in complete synchronism with the rotation of the platen, allowing lines to be drawn by the pen on the sheet accurately without distortion. A sheet of so-called letter paper having no feed holes can be clamped between the teeth and the grooves for positive feeding. Therefore, a wide variety of types of print paper can be used on the pen recorder. The grooves in the presser rollers prevent the teeth which project outwardly from the platen from damaging the presser rollers, thereby giving the mechanism a long service life.

Although certain preferred embodiments have been shown and described, it should be understood that many changes and modifications may be made therein without departing from the scope of the appended claims.

What is claimed is:

1. A mechanism for use in a recorder for pressing a sheet of recording paper against a platen, including two support members located at respective end portion of the platen to define a printing area of the recording paper therebetween, said support members each carrying a pair of rollers spaced circumferentially around said platen, a presser bar lying along the platen and spaced circumferentially from said rollers and said printing area, means including a pivotally mounted cover extending over the platen to shield said printing area, and means responsive to pivotal movement of said cover for moving each of said rollers and said presser bar away from the platen to enable positioning of the recording paper relative to said platen.

2. A sheet presser mechanism for use in a recorder, comprising:

(a) a platen rotatable about its own axis;

(b) a drawing instrument directed toward said platen and movable axially thereof;

(c) a pair of spaced support members movable toward and away from said platen;

(d) a pair of presser roller units rotatably supported on said support members, respectively, and positioned respectively at axial ends of said platen, said presser roller units being normally held resiliently against said platen and having shafts parallel to said platen;

(e) a presser bar spaced from said presser rollers in a circumferential direction of said platen and extending parallel to said platen;

(f) means including a pivot lever supporting said presser bar for moving the latter away from said platen;

(g) means including a pair of presser members actuatable in response to turning movement of said pivot lever to move said presser bar away from said platen for pushing said support members to move said presser roller units away from said platen, and (h) means including a cover plate attached to said pivot lever for covering said drawing instrument and pivoting said pivot lever to move said presser members in response to movement of said cover plate.

3. A sheet presser mechanism according to claim 2, wherein each of said presser roller units is composed of a pair of presser rollers spaced a distance from each other circumferentially around said platen and supported on one of said support members.

4. A sheet presser mechanism according to claim 2, wherein said support members are disposed respectively at the ends of said platen and each include a pair of shafts spaced from each other circumferentially around said platen, each of said presser roller units being composed of a pair of presser rollers rotatably mounted on said shafts, respectively, one of said two shafts being located upwardly of the other and extending from the support member axially over an end portion of said platen.

5. A sheet presser mechanism according to claim 2, including circumferential arrays of teeth on said platen in radial alignment with said presser roller units, said presser roller units having means comprising grooves for accommodating therein said circumferential arrays of teeth to avoid direct engagement of the latter with said presser roller units.

* * * * *